US008607492B2

(12) United States Patent
Hartley et al.

(10) Patent No.: US 8,607,492 B2
(45) Date of Patent: Dec. 17, 2013

(54) MODULAR VERTICAL FOREGRIP

(75) Inventors: Scott Hartley, Wilsonville, OR (US); Drew Essig, Wilsonville, OR (US); Sam Nicoletti, Portland, OR (US); Devon Croswell, Portland, OR (US); Patrick Barrett, Portland, OR (US); Dale Suzuki, Wilsonville, OR (US); Jeffrey Hoblitt, Wilsonville, OR (US)

(73) Assignee: Crimson Trace, Inc., Wilsonville, OR (US)

( * ) Notice: Subject to any disclaimer, the term of this patent is extended or adjusted under 35 U.S.C. 154(b) by 223 days.

(21) Appl. No.: 13/192,416

(22) Filed: Jul. 27, 2011

(65) Prior Publication Data

US 2012/0055061 A1 Mar. 8, 2012

Related U.S. Application Data

(60) Provisional application No. 61/368,200, filed on Jul. 27, 2010.

(51) Int. Cl.
*F41C 23/16* (2006.01)

(52) U.S. Cl.
USPC ..... 42/72

(58) Field of Classification Search
USPC ..... 42/71.01, 71.02, 72, 73, 84
See application file for complete search history.

(56) References Cited

U.S. PATENT DOCUMENTS

| | | | | |
|---|---|---|---|---|
| 7,243,454 | B1 * | 7/2007 | Cahill | 42/72 |
| 7,409,791 | B2 | 8/2008 | Moody et al. | |
| 7,412,793 | B2 | 8/2008 | Moody et al. | |
| 7,490,429 | B2 | 2/2009 | Moody et al. | |
| 7,559,167 | B1 | 7/2009 | Moody et al. | |
| 7,568,304 | B1 | 8/2009 | Moody et al. | |
| 7,658,029 | B1 | 2/2010 | Moody et al. | |
| 7,658,030 | B2 | 2/2010 | Moody et al. | |
| 7,685,756 | B2 | 3/2010 | Moody et al. | |
| 7,743,547 | B2 | 6/2010 | Houde-Walter | |
| 7,900,390 | B2 | 3/2011 | Moody et al. | |
| 8,201,353 | B1 * | 6/2012 | Swan | 42/71.01 |
| 2006/0277809 | A1 | 12/2006 | Moody et al. | |

(Continued)

OTHER PUBLICATIONS

Crimson Trace, Inc. Website, CTC Defense: Primary Target Acquisition Systems, Copyright 2011, http://www.crimsontrace.com/military/CTCDefenseHome/PrimaryTargetAcquisitionSystems/tabid/335/Default.aspx.

(Continued)

*Primary Examiner* — Bret Hayes
(74) *Attorney, Agent, or Firm* — Schwabe, Williamson & Wyatt, P.C.

(57) ABSTRACT

Embodiments herein relate to the field of weapon accessories, and, more specifically, to modular, electrically powered weapon accessories. Various embodiments include powered modular vertical foregrips that may serve as platforms for multiple firearms accessories, such as modular laser and/or LED lighting and/or sighting systems, radiofrequency receiver and/or transmitter systems, and/or other powered accessories. Various embodiments may be adapted to couple to a mounting rail, such as a Picatinny or Weaver rail, and particular embodiments may be adapted to couple to a lower hand guard quad-rail of an M4 or other small arms weapon. Systems in accordance with various embodiments may provide a platform that may consolidate multiple accessory devices and functions into a single ergonomic and compact unit. Thus, in some embodiments, systems disclosed herein may greatly reduce the size and weight of the total accessory package, and may provide an extremely ergonomic platform that is much easier to manage before, during, and after operations.

17 Claims, 7 Drawing Sheets

(56) References Cited

U.S. PATENT DOCUMENTS

| | | | | |
|---|---|---|---|---|
| 2008/0141576 | A1 | 6/2008 | Moody et al. | |
| 2008/0163532 | A1 | 7/2008 | Moody et al. | |
| 2008/0263945 | A1 | 10/2008 | Moody et al. | |
| 2009/0288323 | A1 | 11/2009 | Moody et al. | |
| 2009/0320347 | A1 | 12/2009 | Moody et al. | |
| 2010/0018101 | A1 | 1/2010 | Moody et al. | |
| 2010/0122484 | A1 | 5/2010 | Moody et al. | |
| 2010/0132239 | A1 | 6/2010 | Moody et al. | |
| 2010/0192448 | A1* | 8/2010 | Darian | 42/84 |
| 2010/0275489 | A1* | 11/2010 | Cabahug et al. | 42/71.01 |
| 2012/0055061 | A1* | 3/2012 | Hartley et al. | 42/84 |

OTHER PUBLICATIONS

Crimson Trace, Inc. Website, Discontinued Products, Copyright 2011, http://www.crimsontrace.com/Home/Products/Discontinued Products/tabid/202/Default.aspx; http://www.crimsontrace.com/Home/Products/AR15/VF302/tabid/203/Default.aspx; and http://www.crimsontrace.com/Home/Products/AR15/VF302M/tabid/204/Default.aspx.

Brownells, Surfire Website, Copyright 2011, M952V Millennium Universal Weapon Light, http://www.brownells.com/.aspx/pid=38849/Product/M952V-Millennium-Universal-Weapon-Light.

USNightVision Website, Copyright 2011, AN/PEQ-15 (ATPIAL), http://www.usnightvision.com/anpeq-15atpial.aspx.

* cited by examiner

MODULAR VERTICAL FOREGRIP

CROSS REFERENCE TO RELATED APPLICATIONS

The present application is related to and claims priority to U.S. Provisional Patent Application No. 61/368,200, filed Jul. 27, 2010, entitled "MODULAR VERTICAL FOREGRIP," the disclosure of which is hereby incorporated by reference in its entirety.

TECHNICAL FIELD

Embodiments herein relate to the field of weapon accessories, and, more specifically, to modular, electrically powered weapon accessories.

BACKGROUND

Users of weapons have often found it convenient to attach accessories of various types to their weapons, particularly firearms. Such accessories include foregrips, laser sighting devices, flash lights (both navigation lights and tactical lights), and radio frequency (RF) transmitters and/or receivers. Accessory rails mounted to a weapon make it easy to attach or remove accessories. These rails usually conform to a standard such as the Picatinny or Weaver standards to ensure that accessories made by different manufacturers can attach to the same rail.

Weapon users often have multiple accessories attached to their weapon. Attaching multiple accessories can undesirably affect the size and weight of the firearm, cause excessive power consumption, render the firearm inefficient to operate and maintain, and increase the effort required for procuring, maintaining, and training on multiple systems for one weapon. As an example, the M4, which was designed to be compact and easy to handle in a variety of urban warfare situations, has become bulky and hard to handle due to the number of accessories it is paired with. This causes torque on the weapon due to large heavy accessories, snag hazards, impact hazards, and increases the risk of loose electrical wires and pressure switches.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1B:
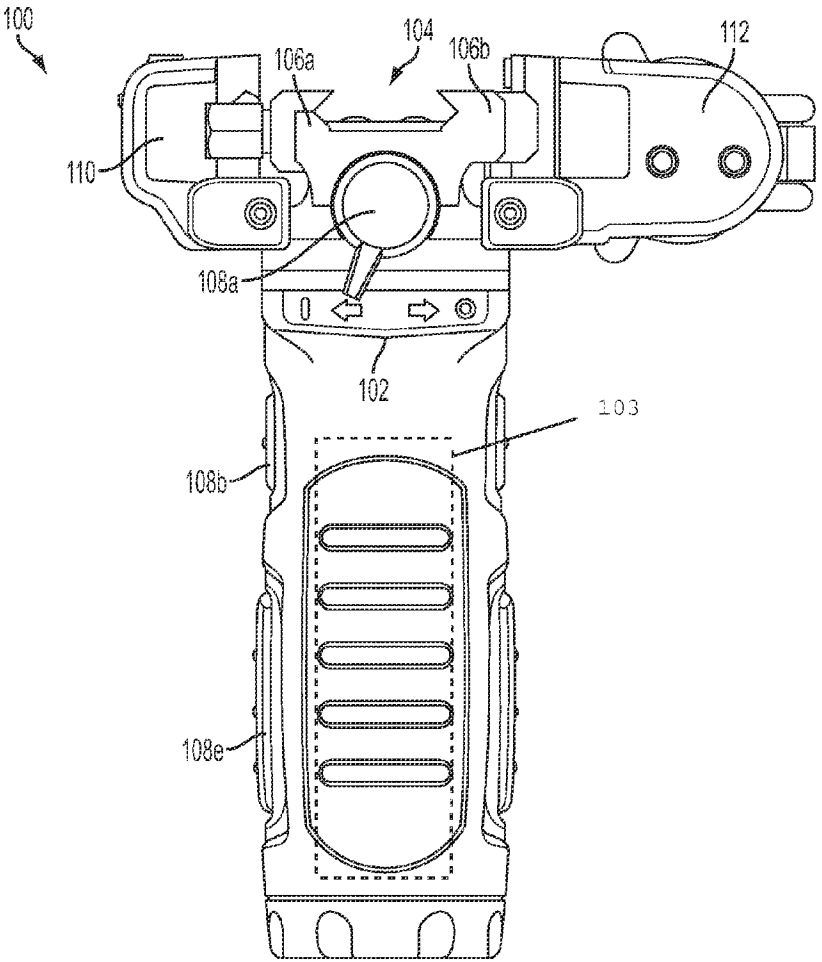
FIGS. 1A and 1B are side (FIG. 1A) and front (FIG. 1B) views of an example of a modular vertical foregrip device with exemplary laser and LED component modules installed, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments herein provide interchangeable, modular, multi-function electro-optics and/or communications accessory devices that may be suitable for use with firearms, including small arms systems such as the M4 and M11. Various embodiments include powered modular vertical foregrips that may serve as platforms for multiple firearms accessories, such as modular laser and/or LED lighting and/or sighting systems, radiofrequency receiver and/or transmitter systems, and/or other powered accessories. Various embodiments may be adapted to couple to a mounting rail, such as a Picatinny or Weaver rail, and particular embodiments may be adapted to couple to a lower hand guard quad-rail of an M4 or other small arms weapon. Systems in accordance with various embodiments may provide a platform that may consolidate multiple accessory devices and functions into a single ergonomic and compact unit. Thus, in some embodiments, systems disclosed herein may greatly reduce the size and weight of the total accessory package, and may provide an extremely ergonomic platform that is much easier to manage before, during, and after operations.

Various systems may include three or more primary accessory functions or devices, for instance a vertical foregrip, one or more visible spectrum and/or infrared laser aiming devices, one or more white light and/or infrared illumination devices, one or more radiofrequency communications devices, and/or one or more power supplies for providing power to additional accessories. In some embodiments, the vertical foregrip may house batteries, and may provide powered modular component docks for laser sighting devices, lights, communications devices, and/or accessory power supplies (e.g., component modules). Various embodiments also may provide a very efficient and ergonomic switch format that may allow control of a variety of accessories without altering a user's shooting position. In some embodiments, the laser and LED lighting and/or sighting component modules, communications component modules, and/or accessory power supply modules may be modular and/or swappable, and may provide a variety of functions for numerous applications.

In some embodiments, the disclosed systems may provide an LED or infrared visual disruption light for escalations of force (EOF) and close quarter combat (CQC) tactics. Unlike other vertical grip systems, in some embodiments, the disclosed systems may incorporate both an LED light component and a modular laser sighting component directly into the body of the vertical grip, for instance coupled to integral powered modular docks. In embodiments, this integration may greatly streamline the size, weight, and accessory bulk that protrudes from the firearm. In addition, in some embodiments, the weight of the accessories may be efficiently distributed on the bottom rail and close to the center line of the weapon.

Figure 1A:
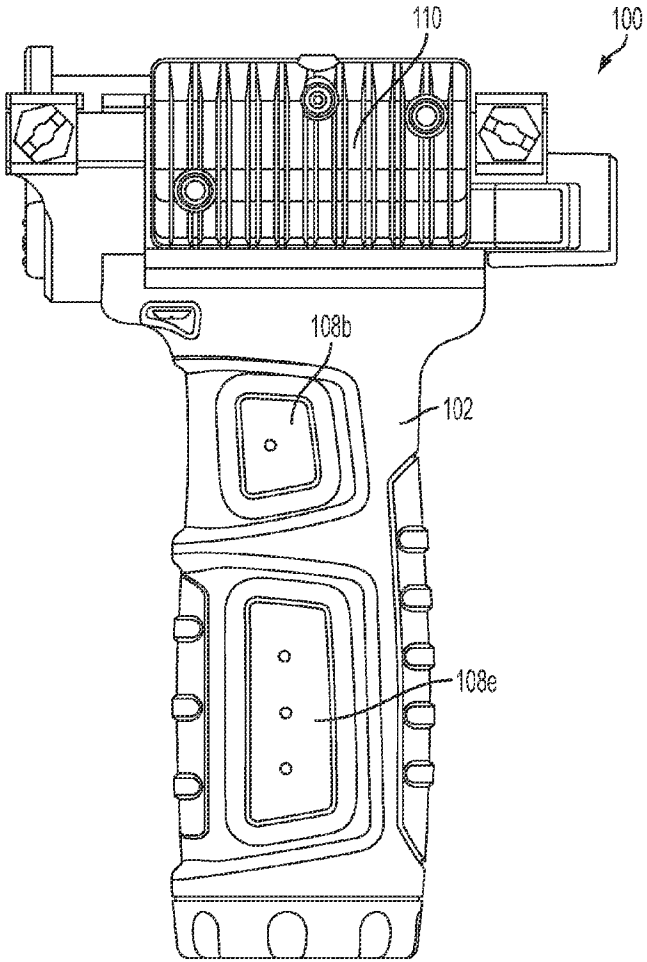
Figure 3A:
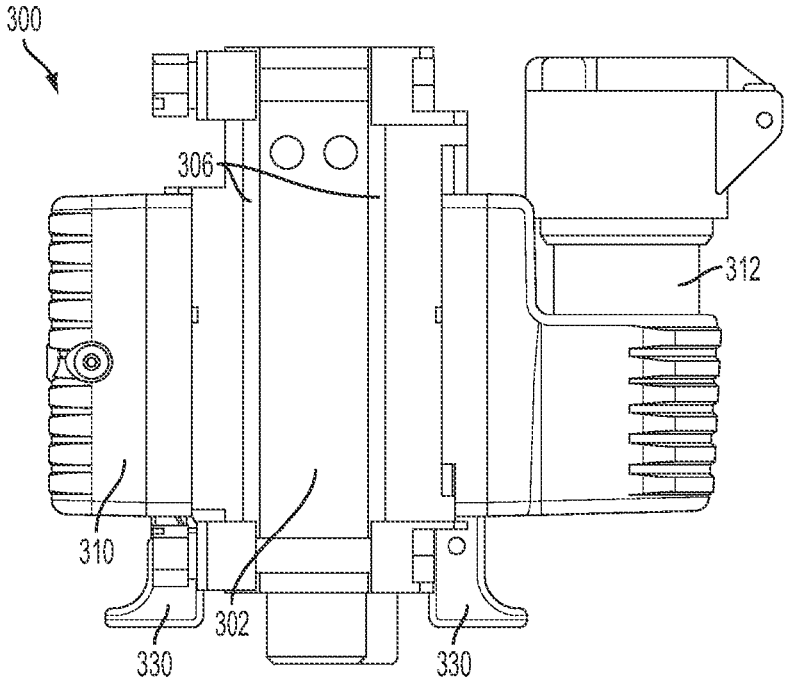
FIGS. 3A and 3B are top (FIG. 3A) and bottom (FIG. 3B) views of an example of a modular vertical foregrip device with exemplary laser and LED component modules installed, in accordance with various embodiments.
Figure 3B:
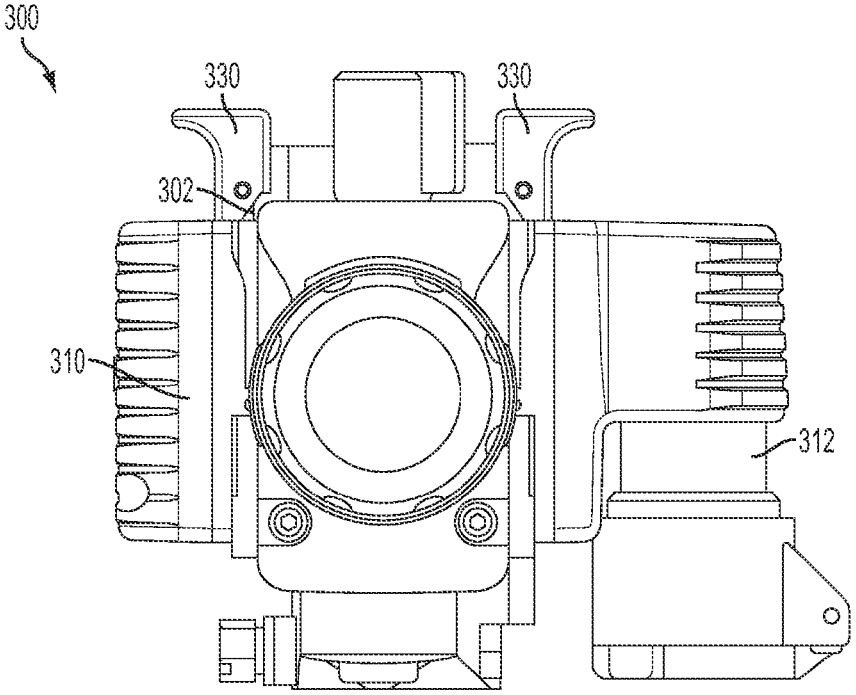
Figure 4A:
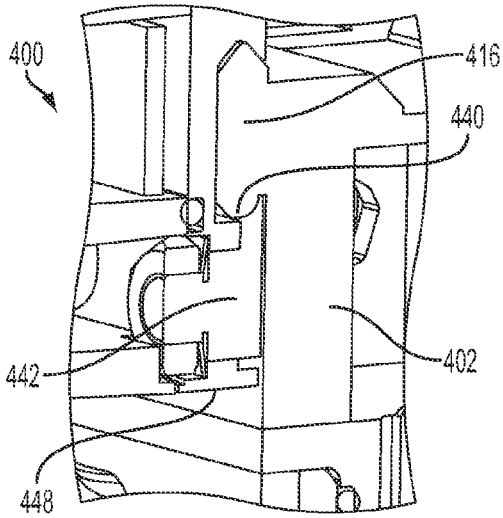
FIGS. 4A, 4B, and 4C are a cross-sectional view of an example of a powered component module dock (FIG. 4A), a perspective view of an example of a component module release arm (FIG. 4B), and an exploded view of an example of a powered component module dock (FIG. 4C), in accordance with various embodiments.
Figure 4B:
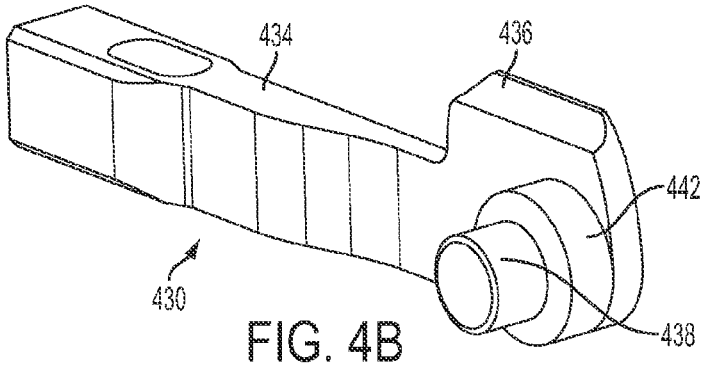
Figure 4C:
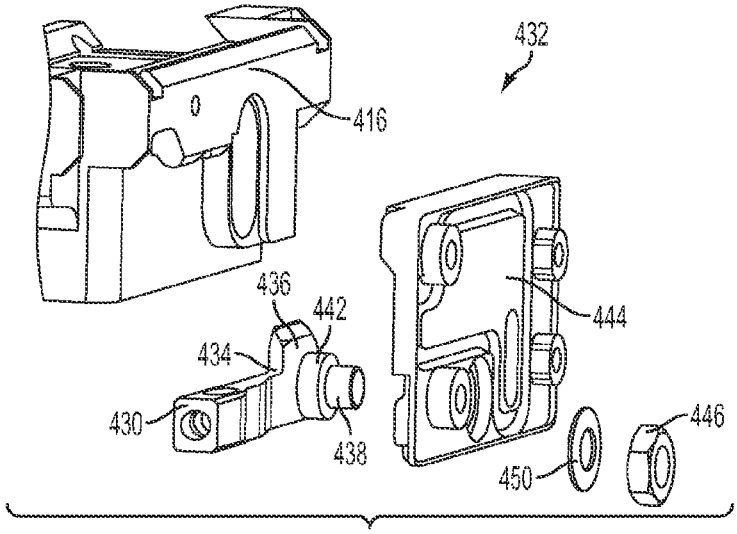
Figure 5A:
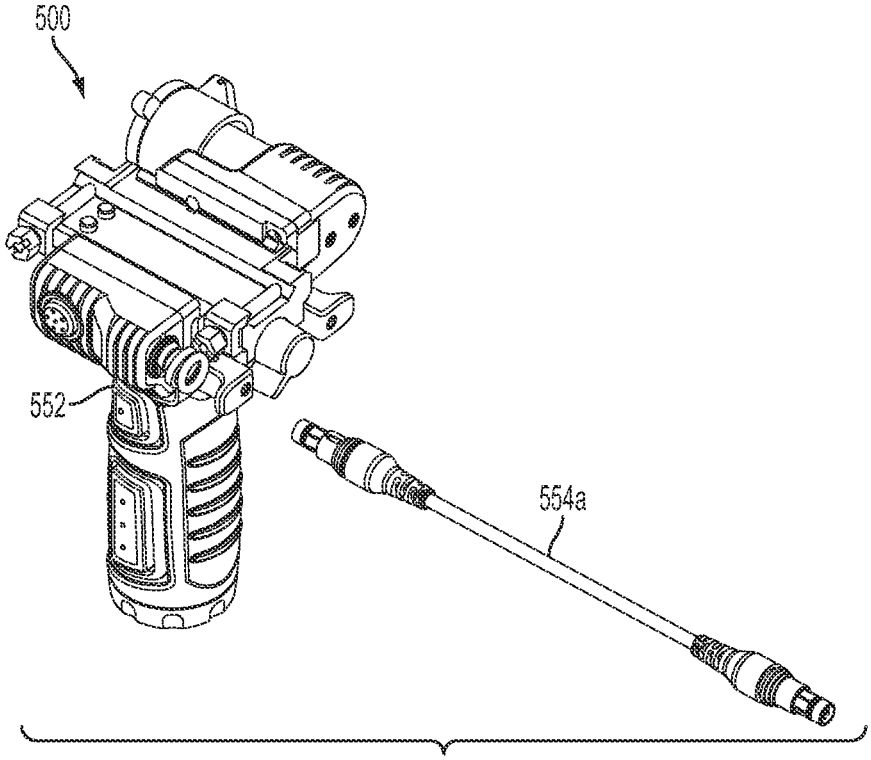
FIGS. 5A and 5B show perspective views of two examples of an accessory power module; in accordance with various embodiments.
Figure 5B:
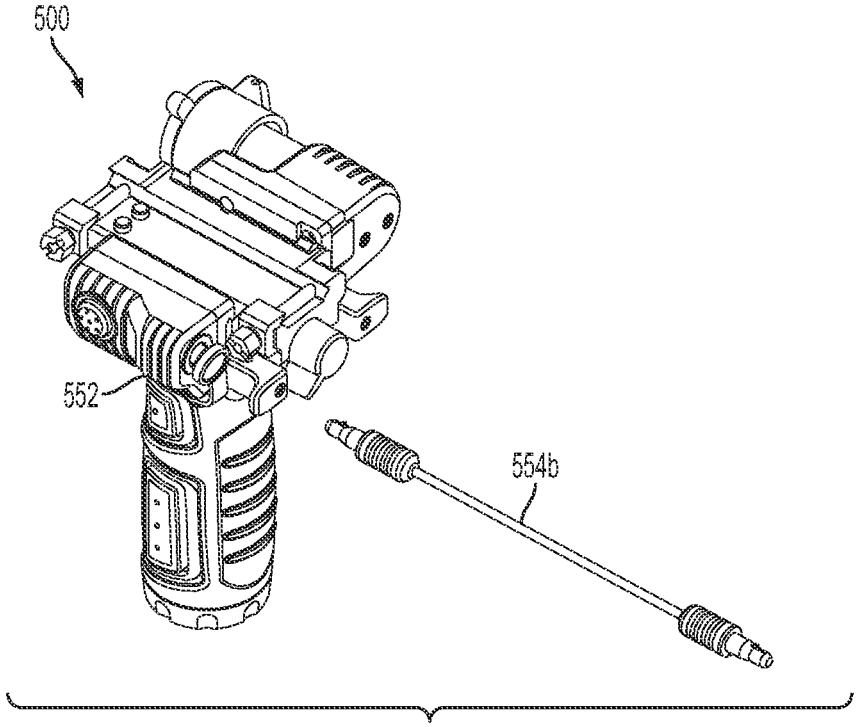
Figure 6A:
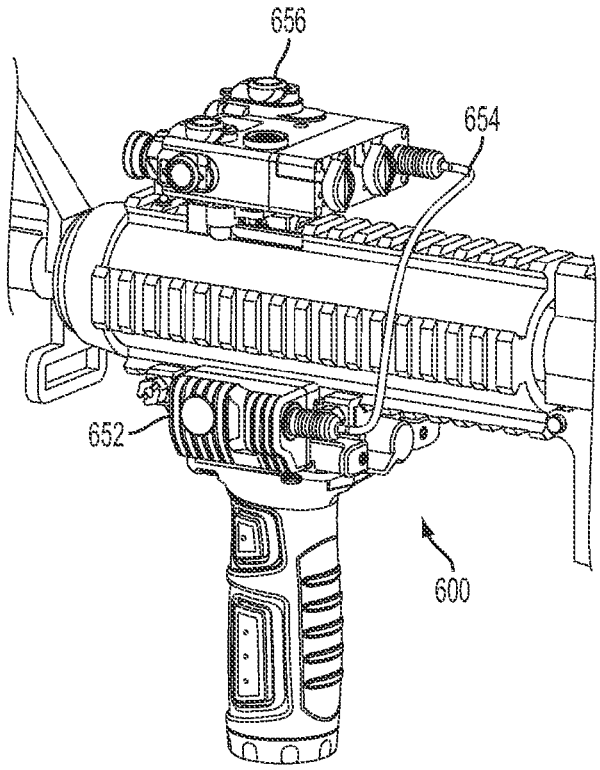
FIGS. 6A and 6B show perspective views of two examples of an accessory power module powering an additional accessory mounted to a top rail on a firearm; in accordance with various embodiments
Figure 6B:
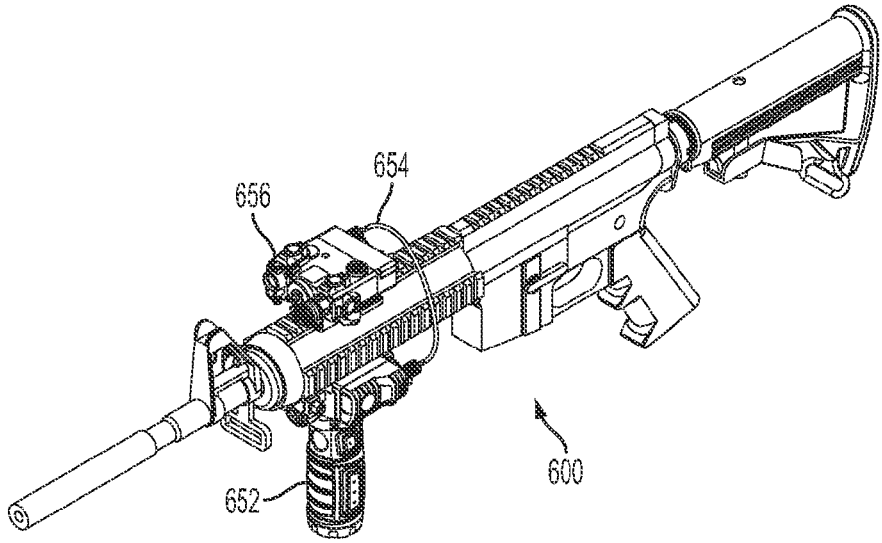

FIGS. 1A and 1B are side (FIG. 1A) and front (FIG. 1B) views of an example of a modular vertical foregrip device with exemplary laser and LED component modules installed; FIGS. 2A, 2B, 2C and 2D are perspective views (FIGS. AC and 2B) of an example of a modular vertical foregrip device with no component modules installed, and close-up views of a component module registration element (FIG. 2C) and a rail registration element (FIG. 2D); FIGS. 3A and 3B are top (FIG. 3A) and bottom (FIG. 3B) views of an exemplary modular vertical foregrip device with laser and LED component modules installed; FIGS. 4A, 4B, and 4C are a cross-sectional view of an example of a powered component module dock (FIG. 4A), a perspective view of an example of a component module release arm (FIG. 4B), and an exploded view of an example of a powered component module dock (FIG. 4C); FIGS. 5A and 5B show perspective views of two examples of an accessory power module; and FIGS. 6A and 6B show perspective views of two examples of an accessory power module powering an additional accessory mounted to a top rail on a firearm, all in accordance with various embodiments.

As shown in FIGS. 1A and 1B, system 100 may include a rail-mountable foregrip 102 with a rail-mounting member 104, at least two component module mounting members 106*a*, 106*b*, and one or more user interface elements 108*a*, 108*b*, 108*c* for controlling the installed component modules 110, 112 and/or other accessory devices. In various embodiments, user interface elements may include switches, buttons, dials, and the like. In use, system 100 may be mounted via rail-mounting member 104 on a lower rail mount system on a firearm, such as a Picatinny or Weaver rail mount system or NATO accessory rail. Optional swappable components, such as laser module 110 and/or LED module 112, may be mounted to tangs or component module docking members 106*a*, 106*b* on system 100, and may be powered by a battery 103 housed within a battery compartment (not shown) within foregrip 102. In some embodiments, the battery may also power additional accessory components mounted elsewhere on the firearm, and such additional accessory components may be controlled by user interface elements 108 such as switches 108*a*, 108*b*, 108*c*. In some embodiments, additional or alternate mission-specific component modules may be mounted to component mounting members 106*a*, 106*b*, and may be controlled by one or more switches 108*a*, 108*b*, 108*c*. Thus, in various embodiments, system 100 may provide a versatile, compact, ergonomic, and lightweight system for controlling a full complement of customizable accessories.

Figure 2B:
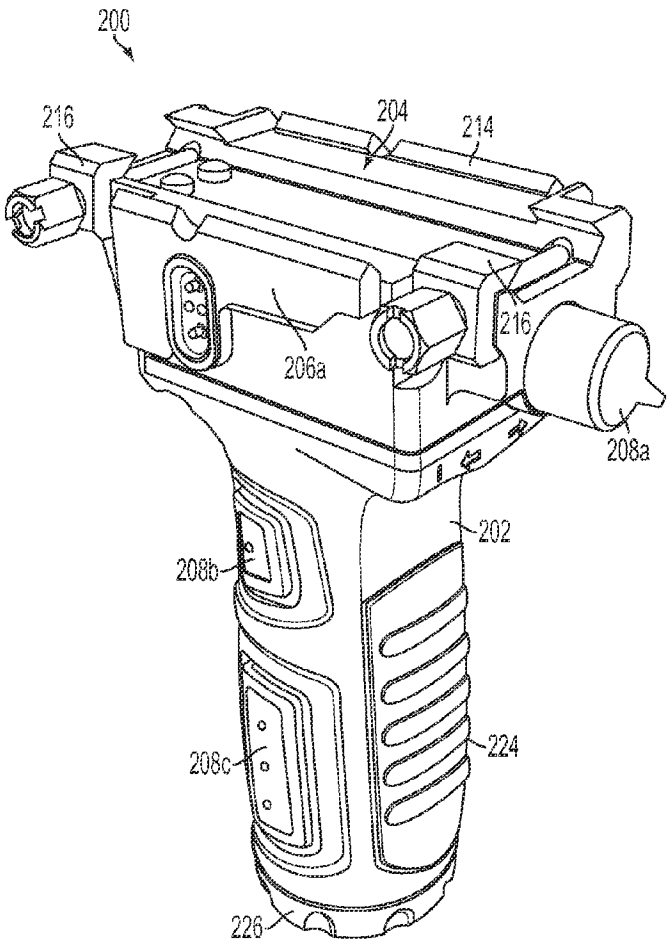
FIGS. 2A, 2B, 2C, and 2D are perspective views (FIGS. 2A and 2B) of an example of a modular vertical foregrip device without component modules installed, and close-up views of an example of a module registration element (FIG. 2C) and a rail registration element (FIG. 2D), in accordance with various embodiments.
Figure 2A:
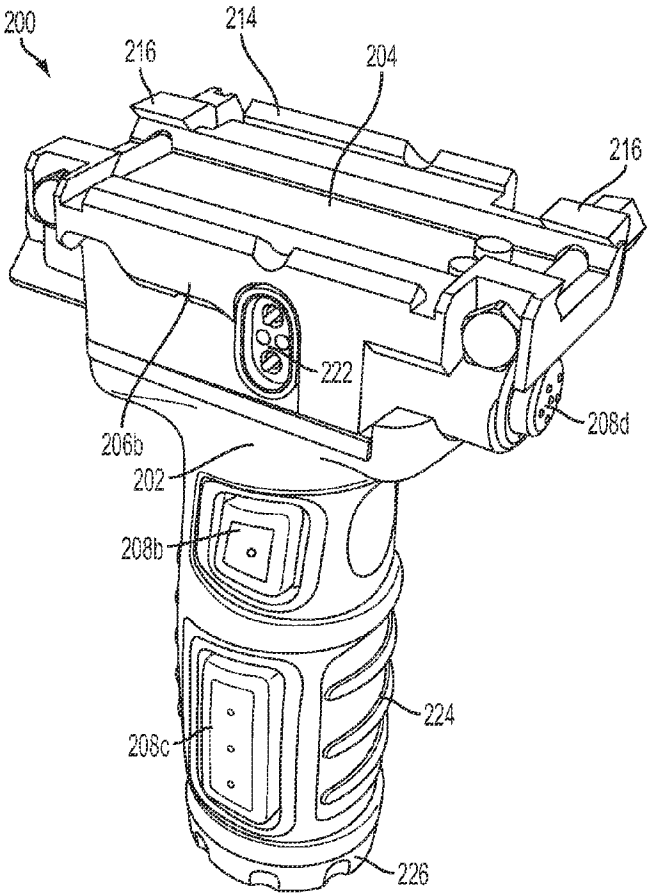
Figure 2C:
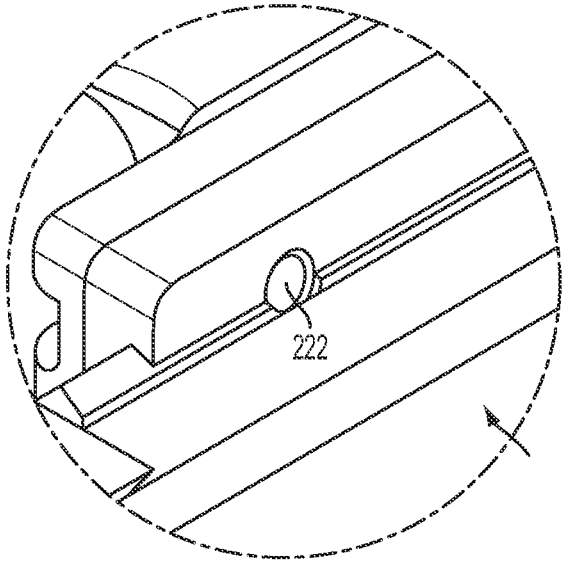
Figure 2D:
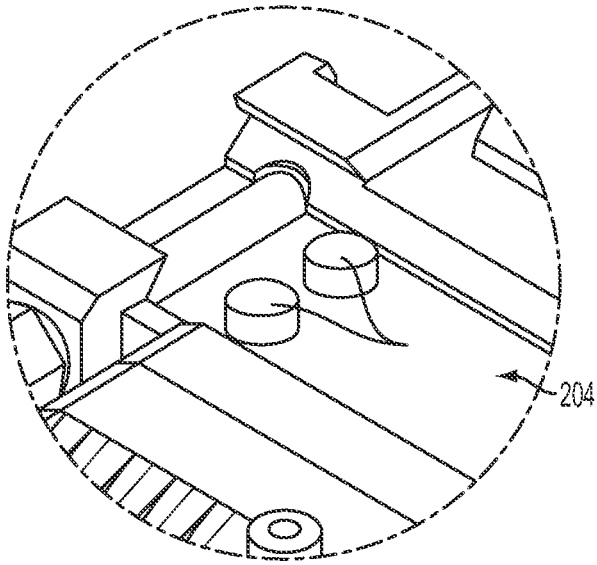

As illustrated in FIGS. 2A-2D, in various embodiments, the system 200 may include a rail-mountable foregrip 202 with a rail-mounting member 204 that is compatible with standard bottom-mounted rail systems, such as Picatinny, Weaver, or NATO accessory rails. As illustrated in FIGS. 2A and 2B, in embodiments, rail mounting member 204 may include one or more rail members 214 and one or more rail clamps 216. In various embodiments, rail member 214 may engage a rail mounted on the firearm, such as a Pickatinny, Weaver, or NATO rail, and rail claims 216 may be used to secure system 200 to the rail. As shown in FIG. 2D, in some embodiments, rail-mounting member 204 also may include one or more rail registration pins 218 to provide tactile feedback to the user and to ensure that rail-mounting member 204 is positioned for proper coupling to the rail. In some embodiments, tactile feedback from rail registration pins 218 may allow a user to verify non-visually that rail mounting member 204 is properly seated on the rail, which may be advantageous, for instance in darkness or low light conditions.

As illustrated in FIGS. 2A and 2B, in various embodiments, component module mounting members 206*a* and 206*b* may include one or more foregrip power contacts 222 that may be configured to electrically couple and provide power to a component module coupled thereto. In various embodiments, a corresponding component module (not shown) may include corresponding module power contacts configured to mate with foregrip power contacts 222. Additionally, as illustrated in FIG. 2C, in various embodiments, component mounting members 206*a* and 206*b* may also include on or more module registration pins or module registration pin receptacles 222 that may be configured to engage corresponding elements on the installed component module. In some embodiments, tactile feedback from module registration pins or module registration pin receptacles 222 may allow a user to verify non-visually that a component module is properly seated on the module mounting member 206*a*, 206*b*, which may be advantageous, for instance in darkness or low light conditions.

In various embodiments, in addition to coupling to laser component module 210 and LED component module 212, component mounting members 206*a*, 206*b* may couple to other visible and non visible laser devices and illuminators, power ports for additional accessories, such as accessories mounted on other parts of the firearm, imaging and audio or video capturing components, friend or foe recognition and communication devices, or other devices. In some embodiments, a plurality of user interface elements 208 may be provided. In the illustrated example, 208*a* may be a rotary switch that may be configured to switch between various modes of operation, such as continuous or flashing modes, laser or LED mode, or the like. In some embodiments, system 200 may include one or more LED component module control switches 208*b* may be provided that may be configured to activate an LED component module, and/or one or more laser component module control switches 208*c*. In some embodiments, such component module control switches may be positioned and configured to allow a user to control one or more component modules without altering his or her shooting position. In some embodiments, a separate dazzler switch 208*d* may be provided to activate a visual disruption light.

Also provided in some embodiments is an ergonomic grip portion 224 and/or a closure 226 for the battery compartment, such as a screw-on cap. In further embodiments, system 200 may provide a waterproof exterior, whether or not component modules 210, 212 are installed on foregrip 202. Thus, in various embodiments, one or more component modules 210, 212 may be coupled and/or uncoupled from foregrip 202 in any field conditions, including wet conditions.

As discussed above, in various embodiments, foregrip 202 may include a battery compartment for housing a power source. In some embodiments, instead of two sets of batteries (four total batteries) as are utilized by other multifunctional aiming lights (MFAL) and tactical lights, the disclosed modular vertical foregrip systems may provide all laser and light functions with one set of batteries, such as CR123 batteries (e.g., two total batteries). In some embodiments, this may result in a reduction of battery consumption and may make the unit less expensive to operate. In other embodiments, other power sources, such as solar cells, may be used to power the device.

In various embodiments, rail-mountable foregrip 202 may include a set of two or more user interface elements 208 that may be size- and feel-indexed to differentiate between two or more primary functions (for instance, laser and LED) in a quick and decisive manner. In some embodiments, such user interface elements 208 may be switches 208*b*, 208*c* that may be included on a co-molded grip portion 224 that may create a moisture- and water-impermeable switching surface. Thus, in various embodiments, system 200 may serve as a single switch platform that allows a user to maintain a shooting position and grip while providing a means for quickly activating a variety of laser and light functions, and/or other accessories. In particular embodiments, system 200 may also include one or more interfaces for programmability, so that a user may, for instance, program user interface elements 208 to operate a desired set of accessory component modules and/or other devices in a desired fashion.

User interface elements 208 may be configured in a variety of different ways in order to control operation of system 200. In one specific, non-limiting example, user interface elements 208 may be configured as follows:

Component Modules:

A: White Light

B: Laser

Switches:

R. Rotary Mode Selector Switch

1. Switch momentary tactual dome

2. Switch momentary tactual dome

3. Switch momentary tactual dome

4. Switch momentary tactual dome

5. Switch Frequency or Duty Cycle Shift

| Rotary Switch Position | Switch 1 | Switch 2 | Switch 3 | Switch 4 | Switch 5 |
|---|---|---|---|---|---|
| 4 Dead OFF | No Action | No Action | No Action | No Action | No Action |
| 3 | B ON | No Action | A ON | No Action | B 8-Hz Strobe |
| 2 | No Action | A ON | No Action | B ON | A 8-Hz Strobe |
| 1 | B ON | A ON | A ON | B ON | A & B Strobe |

In this example, switches 1-5 may all be momentary tactical snap domes, and power may be terminated when activation pressure is released. In some embodiments, switch 5 may activate a frequency or duty cycle shift in addition to power transmission, unlike switches 1 thru 4, which only control power transmission. In embodiments, the frequency or duty cycle shift created by activation of switch 5 may be monitored by an on-board circuit in each module. Thus, in various embodiments, each component module may be configured to operate in two independent modes depending on which switch is activated. For example, in some embodiments, if a two-function component module is not included, the frequency or duty cycle sensing circuit may not be added to the module as this may have no effect on activation. In embodiments, modules without the sensing circuit may not strobe or have dual functionality capabilities when switch 5 is activated, but may activate nevertheless. In some embodiments, in the white light component module A, if a frequency shift circuit is present; a strobe rate may be created by circuitry in the module.

In the specific embodiment described above, LED or laser component modules 212, 210 may be installed on either side of system 200, and may allow LED component modules 212 to flash when the dazzler switch 208*d* is actuated, while laser modules 210 may be switched on constantly. In particular embodiments, when dazzler button 208*d* is activated and switch logic dictates, the power output to the selected module 210, 212 may be maintained at a high level, with a narrow (e.g., approximately 10 microseconds wide) negative going pulse to ground level is output at about 16 Hertz. In some embodiments, in laser component modules 210, the input capacitor may hold the input power at a sufficient level such that laser component module 210 does not blink. In particular embodiments, in LED component module 212, an LC filter may be used to maintain power to the circuit, while the input may also be routed by way of a resistor to the clock input of a Flip Flop that switches phase with each pulse. In some embodiments, the result may be a blinking LED component module 212 that blinks at about an 8 Hz rate.

FIGS. 3A and 3B illustrate top (FIG. 3A) and bottom (FIG. 3B) views of an exemplary modular vertical foregrip device with laser and LED component modules installed. In various embodiments, system 300 may include one or more latch quick release members 330 on component module 310, 312 (or, alternatively, on foregrip 302, for example on component module docking members 306), that may be used to quickly and easily decouple a component module from the component module docking members 306.

FIG. 4 illustrates a specific, non-limiting example of a system 400 having one or more latch quick release members 430. In the illustrated embodiment, such latch quick release members 430 may be elements of a quick release clamp system 432 that may incorporate a non-angulated mating surface such as a radiused face 436 that may provide for easier coupling of components, thereby enhancing the interchangability of component modules in the field. In some embodiments, force-loaded axial travel of the component module may provide self-adjusting tolerance compensation. In various embodiments, such a quick release system 432 also may use a circular plane interface for registration of the component module to the component module docking member 406. For example, in some embodiments, latch quick release member 430 may be coupled to a cam 434 that may have a non-angular radiused face 436, and cam 434 may be rotated about a cam shaft 438. Rotation of cam 434 may cause the radiused face 436 to engage a correspondingly radiused pivot surface 440 on foregrip 402. This engagement may allow a user to easily and removably couple a component module.

In various embodiments, cam shaft 438 may include a symmetrical shoulder 442 that may provide a bearing surface that engages the corresponding pivot surface 448 of the modular accessory plate 444, and a threaded upper portion that a retaining nut 446 may engage to hold the cam 434 in place. Finally, in some embodiments, a spring washer 450 such as a Bellville washer, may be disposed between retaining nut 446 and the flange to provide tension that may allow cam 434 to pivot and yet remain coupled to modular accessory plate 444. Additionally, in various embodiments, the disclosed modular vertical foregrip devices may be configured to power additional accessories, such as multi-function aiming lights (MFAL), such as the PEQ-15/LA-5 MFAL, r AN/PEQ-15 Advanced Target Pointer Illuminator Aiming Light (ATPIAL) and/or the AN/PEQ-15A Dual Beam Aiming Laser-Advanced$_2$ (DBAL-A$_2$) as both a power source and as a switch platform. In various embodiments, this may allow all of the weapon's lasers and lights to be operated at a single ergonomic switch location. FIGS. 5A and 5B show an embodiment of an accessory power component module 552 for use with the foregrips described herein. As illustrated, when accessory power component module 552 is coupled to a component module docking member, accessory power component module 552 may provide power to operation one or more additional accessories, for example, accessories that may not be coupled to system 500, but that may be mounted elsewhere on the firearm. In various embodiments, power cable 554*a* or 554*b* may be used to supply power to accessories monted on other portions of the firearm, and in particular embodiments, power cable 552 may be used to cause additional accessories to be controllable by one or more of the switches mounted on the foregrip. Thus, as shown in FIGS. 6A and 6B, in some embodiments, additional accessories 656 mounted on other parts of the firearm, such as a top rail, may be both powered and controlled by the modular vertical foregrip systems 600 described herein when electrically coupled to an accessory power module 652 via a power cable 654.

In use, in various embodiments, one or more laser component modules 110, 210, 310 may be employed with the systems disclosed herein, for instance visible light lasers for "aim dots" for sighting or aiming the weapon in daylight or illuminated conditions, and/or infrared (IR) lasers with night vision goggles (NVG) for low light conditions. In various embodiments, lasers also may be used to illuminate a field. In various embodiments, a suitable visible red laser may be 5 mW/635 nm, a suitable visible green laser may be 5 mW/532 nm, and a suitable infrared laser may be 5 mW/850 nm.

In use, in some embodiments, an infrared flashlight or LED component module 112, 212, 312 may be used for a flashlight function for general illumination or for visual disruption (dazzler function) for building/room entry to achieve a tactical advantage. For instance, in particular embodiments, LED component modules 112, 212, 312 may be used for visual disruption for close quarters combat (CQC) entry and short range escalation of force (EOF) applications such as area-denial for urban operations, 360° convoy protection, crowd control and area target suppression at night. Thus, LED component modules 112, 212, 312 may be used in conjunction with strobe frequency modulation, punitive color red signal feature, expedient switch format and power level effect testing and analysis. At the same time, in various embodiments, LED component module 112, 212, 312 may be small, comparatively inexpensive, and configured in an eye-safe package. In specific, non-limiting examples, the LED may be used for general illumination at about 200 Lm (high) or 150 Lm (low), and for visual disruption at about 200 Lm @ 8 Hz strobe.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A powered modular foregrip comprising:

a foregrip configured to removably couple with an accessory rail, the foregrip comprising a first accessory module mounting member and a second accessory module mounting member;

an electrical power source disposed in the foregrip;

a first accessory module configured to removably couple to the first accessory module mounting member and configured to draw electrical power from the electrical power source; and a second accessory module configured to removably couple to the second accessory module mounting member and configured to draw power from the electrical power source;

wherein the first and second accessory module mounting members comprise first and second quick-release mounting members, and wherein the first and second quick-release mounting members each comprise a cam member, a latching member, and a latch release member.

2. The powered modular foregrip of claim 1, wherein the first and second accessory modules comprise a visible laser module, an infrared laser module, a dual visible and infrared laser module, an LED module, an infrared illuminator module, a radio transmitter module, a navigation light module, a blank module, an LED stunner module, an accessory power module, an imaging module, an audio capturing module, a video capturing module, a communication module, or a friend/foe recognition module.

3. The powered modular foregrip of claim 2, wherein the visible laser module comprises a red or green laser.

4. The powered modular foregrip of claim 2, wherein the accessory power module is configured to power an additional accessory.

5. The powered modular foregrip of claim 4, wherein the accessory power module is configured to power an accessory that is not mounted on the powered modular foregrip.

6. The powered modular foregrip of claim 1, further comprising a plurality of switches configured to control the first and second accessory modules.

7. The powered modular foregrip of claim 6, wherein the plurality of switches is configured to be actuated by a user without altering the user's firing position.

8. The powered modular foregrip of claim 6, wherein the plurality of switches comprises two or more switches configured to be distinguished by tactile sensation.

9. The powered modular foregrip of claim 1 wherein the first and second accessory modules are independently adjustable for windage and elevation.

10. The powered modular foregrip of claim 1, wherein the cam member and latching member are configured to allow the first and second accessory modules to be uncoupled and recoupled without the need for elevation and/or windage calibration.

11. The powered modular foregrip of claim 1, wherein the first and second quick-release mounting members each comprise a non-angular accessory mating surface.

12. The powered modular foregrip of claim 11, wherein the cam member comprises a non-angular accessory mating surface, and wherein the cam member is configured to be rotatable about a corresponding cam shaft.

13. The powered modular foregrip of claim 12, wherein the first and second quick-release mounting members are configured so that rotation of the cam causes the non-angular accessory mating surface to engage a correspondingly radiused face on the first or second accessory module.

14. The powered modular foregrip of claim 1, wherein the first and second accessory module mounting members each comprise an accessory module registration pin receptacle configured to couple to a corresponding registration pin on the first and second accessory modules.

15. The powered modular foregrip of claim 14, wherein the accessory module registration pin receptacle enables a user to couple a first or second accessory module to a first or second accessory mounting member without the use of vision.

16. The powered modular foregrip of claim 1, wherein the first and second accessory module mounting members each comprise an accessory module registration pin configured to couple to a corresponding registration pin receptacle on the first and second accessory modules.

17. The powered modular foregrip of claim 16, wherein the accessory module registration pin enables a user to couple a first or second accessory module to a first or second accessory module mounting member without the use of vision.

* * * * *